US010796618B2

(12) United States Patent
Nam et al.

(10) Patent No.: US 10,796,618 B2
(45) Date of Patent: Oct. 6, 2020

(54) DISPLAY PANEL DRIVING DEVICE AND DISPLAY APPARATUS HAVING THE SAME

(71) Applicant: Samsung Display Co., Ltd., Yongin-Si, Gyeonggi-Do (KR)

(72) Inventors: Yanguk Nam, Hwaseong-si (KR); Dae-sik Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 33 days.

(21) Appl. No.: 16/130,215

(22) Filed: Sep. 13, 2018

(65) Prior Publication Data

US 2019/0147783 A1 May 16, 2019

(30) Foreign Application Priority Data

Nov. 15, 2017 (KR) ..... 10-2017-0152590

(51) Int. Cl.

| | |
|---|---|
| ***G09G 3/20*** | (2006.01) |
| ***G09G 3/3266*** | (2016.01) |
| ***G09G 3/36*** | (2006.01) |

(52) U.S. Cl.

CPC ..... *G09G 3/20* (2013.01); *G09G 3/3266* (2013.01); *G09G 3/3674* (2013.01); *G09G 3/3696* (2013.01); *G09G 2300/0819* (2013.01); *G09G 2310/08* (2013.01); *G09G 2320/041* (2013.01); *G09G 2330/028* (2013.01); *G09G 2330/04* (2013.01)

(58) Field of Classification Search

CPC ..... G09G 2320/041

See application file for complete search history.

(56) References Cited

U.S. PATENT DOCUMENTS

| | | | | |
|---|---|---|---|---|
| 9,570,027 | B2 | 2/2017 | Kim et al. | |
| 2002/0070914 | A1* | 6/2002 | Bruning | G09G 3/3413 345/102 |
| 2011/0248648 | A1* | 10/2011 | Liu | G09G 3/3406 315/294 |

FOREIGN PATENT DOCUMENTS

| | | | |
|---|---|---|---|
| KR | 2019990013698 | U | 4/1999 |
| KR | 1020060111163 | A | 10/2006 |
| KR | 100739071 | B1 | 7/2007 |

* cited by examiner

*Primary Examiner* — Gustavo Polo
(74) *Attorney, Agent, or Firm* — Cantor Colburn LLP

(57) ABSTRACT

A display panel driving device includes a control signal generator which outputs a driving control signal, a driving unit which receives the driving control signal to output a panel driving signal, a protection circuit unit which receives a feedback current from the control signal generator and compares the feedback current with a reference current to perform a protection operation based on a result of comparison of the feedback current with the reference current, a temperature sensor which senses an ambient temperature, a controller which outputs a selection signal variable depending on the sensed ambient temperature, and a protection operation setting unit which sets a condition of the protection operation in response to the selection signal.

21 Claims, 11 Drawing Sheets

331

| Temperature | Iref1 |
|---|---|
| T1 | Ion_ref1 |
| T2 | Ion_ref2 |
| ⋮ | ⋮ |
| Tn | Ion_refn |

FIG. 8

332

| Temperature | Reference Current(Iref2) |
|---|---|
| T1 | Iclk_ref1 |
| T2 | Iclk_ref2 |
| ⋮ | ⋮ |
| Ti | Iclk_refi |

332a

| Temperature | Reference Current(Tref) |
|---|---|
| T1 | Time_ref1 |
| T2 | Time_ref2 |
| ⋮ | ⋮ |
| Tj | Time_refj |

332b

| Temperature | Reference Count Number(Cref) |
|---|---|
| T1 | Count_ref1 |
| T2 | Count_ref2 |
| ⋮ | ⋮ |
| Tk | Count_refk |

332c

DISPLAY PANEL DRIVING DEVICE AND DISPLAY APPARATUS HAVING THE SAME

This application claims priority to Korean Patent Application No. 10-2017-0152590, filed on Nov. 15, 2017, and all the benefits accruing therefrom under 35 U.S.C. § 119, the content of which in its entirety is herein incorporated by reference.

BACKGROUND

1. Field

The disclosure relates to a display panel driving device and a display apparatus including the display panel driving device. More particularly, the disclosure relates to a display panel driving device that performs an appropriate protection operation depending on a temperature environment and a display apparatus including the display panel driving device.

2. Description of the Related Art

In general, a display apparatus includes a display panel for displaying an image and a driving circuit for driving the display panel.

The display apparatus typically includes a power supply device that includes a circuit for generating a driving voltage to drive the driving circuit, a circuit for shifting a level of a control signal to control an operation of the driving circuit, and the like.

In general, the power supply device includes a protection circuit to sense an over voltage or an over current. A reference value may be set in the protection circuit to determine the over voltage and the over current.

SUMMARY

In a protection circuit of a power supply device of a display apparatus, the reference value is typically set to a fixed value without varying depending on an ambient temperature or an internal temperature of a chip in which the power supply device is installed. Accordingly, an appropriate protection operation by taking into account a temperature environment with a conventional protection circuit may not be effectively performed.

The disclosure provides a display panel driving device that performs an appropriate protection operation depending on a temperature environment.

The disclosure provides a display apparatus including the display panel driving device.

According to an embodiment of the invention, a display panel driving device includes a control signal generator which outputs a driving control signal, a driving unit which receives the driving control signal to output a panel driving signal, a protection circuit unit which receives a feedback current from the control signal generator and compares the feedback current with a reference current to perform a protection operation based on a result of comparison of the feedback current with the reference current, a temperature sensor which senses an ambient temperature, a controller which outputs a selection signal variable depending on the sensed ambient temperature, and a protection operation setting unit which sets a condition of the protection operation in response to the selection signal.

In an embodiment, the control signal generator may include a power circuit unit which converts an input voltage to a gate driving voltage to output the gate driving voltage to the driving unit and a clock signal generator which generates a clock signal and a clock bar signal based on a gate clock signal to output the clock signal and the clock bar signal to the driving unit.

In an embodiment, the feedback current may include a first feedback current and a second feedback current, and the protection circuit unit may include a first protection circuit unit connected to the power circuit unit to receive the first feedback current therefrom, and a second protection circuit unit connected to the clock signal generator to receive the second feedback current therefrom.

In an embodiment, the protection operation setting unit may include a first protection operation setting unit which sets a protection operation condition of the first protection circuit unit and a second protection operation setting unit which sets a protection operation condition of the second protection circuit unit.

In an embodiment, the first protection operation setting unit may include a storage table which stores a level of a first reference current corresponding to a temperature.

In an embodiment, the display panel driving device may further include a voltage compensator which controls a voltage level of the gate driving voltage based on the sensed ambient temperature, and the controller selects a level of the reference current based on the sensed ambient temperature and whether the gate driving voltage is compensated.

In an embodiment, the second protection operation setting unit may include a first storage table which stores a level of a second reference current corresponding to a temperature, a second storage table which stores a time difference from a rising time point of the gate clock signal to a reference time point corresponding to a temperature, and a third storage table which stores a reference count number corresponding to a temperature.

In an embodiment, the second protection circuit unit may hold the level of the second reference current and vary the reference time point depending on the sensed ambient temperature to sense an abnormality in the second feedback current.

In an embodiment, the second protection circuit unit may hold the reference time point and vary the level of the second reference current depending on the sensed ambient temperature to sense an abnormality in the second feedback current.

In an embodiment, the reference count number in the third storage table may have a value which increases as the sensed ambient temperature increases.

In an embodiment, the driving unit may include a gate driver which applies a gate signal to a display panel, and a data driver which applies a data signal to the display panel, where the gate driver may receive the gate driving voltage, the clock signal and the clock bar signal.

In an embodiment, the protection circuit unit, the control signal generator and the protection operation setting unit may be in a single power control chip, and the temperature sensor may sense the ambient temperature at outside of the power control chip.

In an embodiment, the display panel driving device may further include a signal controller which controls the gate driver and the data driver, where the controller may be in the signal controller and transmit the selection signal to the power control chip.

According to an embodiment of the invention, a display panel driving device includes a power control chip which outputs a driving voltage, and a driving unit which receives the driving voltage to output a panel driving signal. In such an embodiment, the power control chip includes a voltage converter which converts an input voltage to the driving voltage, a protection circuit unit which receives a feedback current from the voltage converter and compares the feedback current with a reference current to perform a protection operation based on a result of comparison of the feedback current with the reference current, a temperature sensor which senses a temperature inside the power control chip, and a protection operation setting unit which controls a level of the reference current based on the sensed temperature.

According to an embodiment of the invention, a display apparatus includes a display panel which displays an image and a driving device which drives the display panel. In such an embodiment, the driving device includes a control signal generator which outputs a driving control signal, a driving unit which receives the driving control signal to output a panel driving signal, a protection circuit unit which receives a feedback current from the control signal generator and compares the feedback current with a reference current to perform a protection operation based on a result of comparison of the feedback current with the reference current, a temperature sensor which senses an ambient temperature, a controller which outputs a selection signal variable depending on the sensed ambient temperature, and a protection operation setting unit which sets a condition of the protection operation in response to the selection signal.

In such embodiments of the invention, the conditions (e.g., the level of the reference current, the reference time point, the reference count number, etc.) on which the protection operation is performed are changed depending on the ambient temperature or the temperature in the power control chip, such that the protection operation may be effectively performed by taking into account the ambient temperature and the internal temperature.

Accordingly, in such embodiments, even when the ambient temperature and the internal temperature are changed, the protection circuit of the display apparatus may stably perform the protection operation, and as a result, stability in driving of the display apparatus may be improved.

BRIEF DESCRIPTION OF THE DRAWINGS

The above and other features of the disclosure will become readily apparent by reference to the following detailed description when considered in conjunction with the accompanying drawings, in which:

FIG. 8 is a view showing a table stored in a second protection operation setting unit shown in FIG. 4;

DETAILED DESCRIPTION

Figure 1:
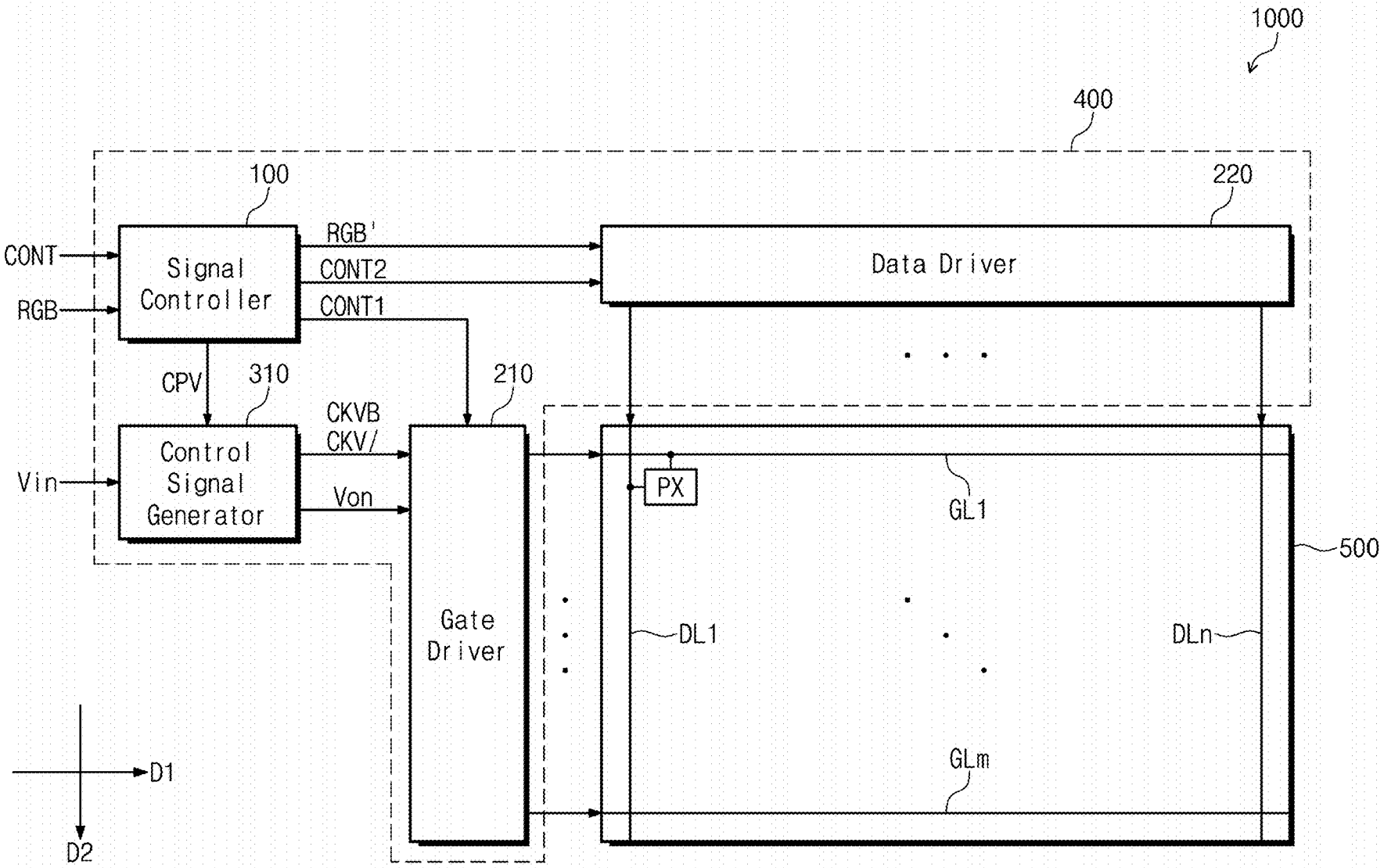
FIG. 1 is a block diagram showing a display apparatus according to an exemplary embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items, it will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, exemplary embodiments of the invention will be described in detail with reference to the accompanying drawings.

FIG. 1 is a block diagram showing a display apparatus 1000 according to an exemplary embodiment of the disclosure.

Referring to FIG. 1, an exemplary embodiment of the display apparatus 1000 includes a display panel 500 that displays an image and a display panel driving device 400 that drives the display panel 500. The display panel driving device 400 includes a signal controller 100, driving units 210 and 220, and a control signal generator 310. In an exemplary embodiment, the driving units 210 and 220 may include a gate driver 210 and a data driver 220.

The signal controller 100 controls an operation of the driving units 210 and 220 and the control signal generator 310. The signal controller 100 receives input image signals RGB and input control signals CONT from an external source (e.g., a host). The input image signals RGB include red grayscale data R, green grayscale data G, and blue grayscale data B with respect to each of pixels. The input control signals CONT may include a master clock signal, a data enable signal, a vertical synchronization signal, and a horizontal synchronization signal.

The signal controller 100 processes the input image signals RGB and outputs image data signals RGB'. The output image data signals RGB' are applied to the data driver 220. The signal controller 100 may include at least "n" functional blocks (not shown) to process the input image signals RGB. Here, n is a natural number. The "n" functional blocks may include functional blocks to perform various operations, e.g., an image quality correction, a stain correction, a color characteristic compensation, and/or an active capacitance compensation with respect to the input image signals RGB.

The signal controller 100 converts the input control signals CONT to internal control signals CONT1 and CONT2, and outputs the internal control signals CONT1 and CONT2 to the driving units 210 and 220. The internal control signals CONT1 and CONT2 include a first control signal CONT1 and a second control signal CONT2. The first control signal CONT1 is applied to the gate driver 210 to control an operation of the gate driver 210. The first control signal CONT1 includes a vertical start signal. The second control signal CONT2 is applied to the data driver 220 to control an operation of the data driver 220. The second control signal CONT2 includes a horizontal start signal, a data clock signal, a data load signal, a polarity control signal, output control signals, or the like.

The signal controller 100 applies a gate clock signal CPV to the control signal generator 310. The control signal generator 310 converts the gate clock signal CPV to a clock signal CKV and a clock bar signal CKVB, and applies the clock signal CKV and the clock bar signal CKVB to the gate driver 210.

The control signal generator 310 receives an input voltage Vin and provides a voltage for an operation of the driving units 210 and 220. In an exemplary embodiment, as shown in FIG. 1, the control signal generator 310 outputs a gate driving voltage Von to the gate driver 210. Although not shown in figures, the control signal generator 310 may apply a gate-off voltage to the gate driver 210 in addition to the gate driving voltage, or generate and apply an analog driving voltage to the data driver 220.

The gate driver 210 generates gate signals based on the first control signal CONT1 to drive a plurality of gate lines GL1 to GLm. The gate driver 210 sequentially applies the gate signals to the gate lines GL1 to GLm. Accordingly, the pixels PX are sequentially driven in the unit of pixels connected to a same gate line, i.e., in the unit of pixel row or on a pixel-row-by-pixel-row basis.

The data driver 220 converts the output image data signals RGB' to image data voltages in response to the second control signal CONT2, and outputs the image data voltages to the display panel 500.

The data driver 220 receives the second control signal CONT2 and the output image data signals RGB' from the signal controller 100. The data driver 220 generates the image data voltages in an analog form based on the second control signal CONT2 and the output image data signals RGB' in a digital form. The data driver 220 may sequentially apply the image data voltages to the data lines DL1 to DLn.

In an exemplary embodiment, the gate driver 210 and/or the data driver 220 may be disposed, e.g., mounted, on the display panel 500 in a chip form or connected to the display panel 500 in a tape carrier package ("TCP") form or in a chip-on-film ("COF") form. In an alternative exemplary embodiment, the gate driver 210 and/or the data driver 220 may be integrated in the display panel 500.

The gate driver 210 may be disposed at one or both of opposing sides of the display panel 500 to sequentially apply the gate signals to the gate lines GL1 to GLm. FIG. 1 shows an exemplary embodiment having a structure in which the gate driver 210 is disposed at one side of the display panel 500 and connected to one ends of the gate lines GL1 to GLm, but the structure of the gate driver 210 are not limited to that shown in FIG. 1. In an alternative exemplary embodiment, the display apparatus 1000 may have a dual-gate structure in which the gate drivers are disposed to be connected to both ends of the gate lines GL1 to GLm.

The display panel 500 includes the pixels PX connected to the gate lines GL1 to GLm and the data lines DL1 to DLn. The gate lines GL1 to GLm extend in a first direction D1, and the data lines DL1 to DLn extend in a second direction D2 crossing the first direction D1. The pixels PX are arranged in a matrix form, and each of the pixels PX is electrically connected to a corresponding one of the gate lines GL1 to GLm and a corresponding one of the data lines DL1 to DLn.

The gate lines GL1 to GLm sequentially receive the gate signals from the gate driver 210 and the pixels PX are thereby turned on. The data lines DL1 to DLn receive the image data voltages from the data driver 220. Accordingly, the image data voltages are applied to the turned-on pixels PX through the data lines DL1 to DLn, and the pixels PX display an image corresponding to the image data voltages.

Figure 2:
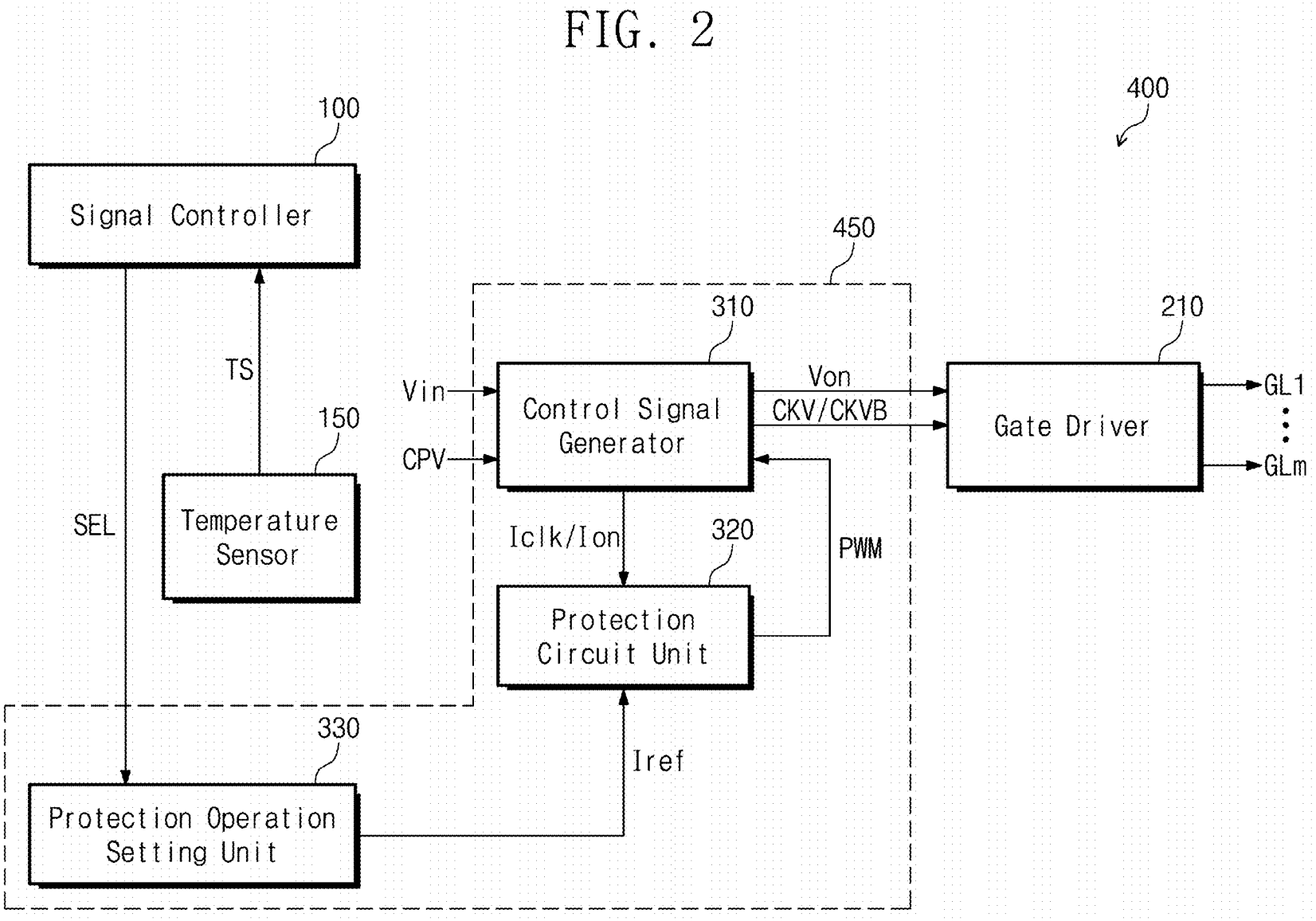
FIG. 2 is a block diagram showing an exemplary embodiment of a display panel driving device shown in FIG. 1.
Figure 3:
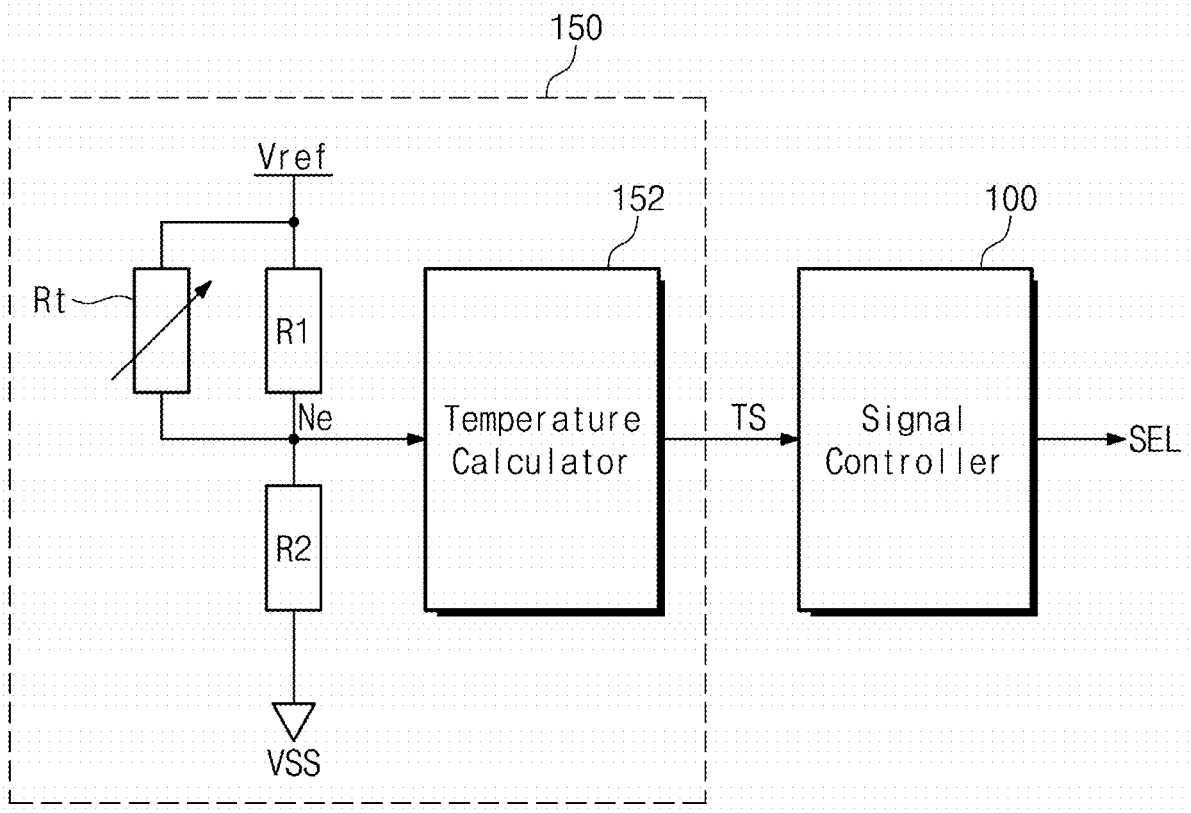
FIG. 3 is a circuit diagram showing an exemplary embodiment of a temperature sensor shown in FIG. 2.

FIG. 2 is a block diagram showing an exemplary embodiment of the display panel driving device 400 shown in FIG. 1, and FIG. 3 is a circuit diagram showing an exemplary embodiment of a temperature sensor 150 shown in FIG. 2.

Referring to FIG. 2, an exemplary embodiment of the display panel driving device 400 may further include a temperature sensor 150, a protection circuit unit 320, and a protection operation setting unit 330. For the convenience of illustration and description, FIG. 2 shows only the gate driver 210 of the driving units 210 and 220 (refer to FIG. 1), but the display panel driving device 400 further includes the data driver 220 as shown in FIG. 1.

The protection circuit unit 320 receives feedback currents Ion and Iclk from the control signal generator 310. The protection circuit unit 320 compares the feedback currents Ion and Iclk with a predetermined reference current Iref, and performs a protection operation for the control signal generator 310 depending on a result of the comparison. The protection operation may include operations in which the control signal generator 310 stops outputting the gate driving voltage Von and/or the clock signal CKV (or the clock bar signal CKVB), and/or the control signal generator 310 controls a voltage level of the above-mentioned signals.

The temperature sensor 150 senses an ambient temperature, and applies a temperature signal TS corresponding to the sensed temperature to the signal controller 100. The signal controller 100 outputs a selection signal SEL based on the temperature signal TS corresponding to the sensed temperature. FIG. 2 shows an exemplary embodiment having a structure in which the signal controller 100 receives the temperature signal TS from the temperature sensor 150, but not being limited thereto. Alternatively, the display panel driving device 400 may include a separate controller that receives the temperature signal TS and outputs the selection signal SEL based on the temperature signal TS.

In an exemplary embodiment, as shown in FIG. 3, the temperature sensor 150 includes a thermistor Rt having a negative temperature coefficient of resistance ("NTC") (hereinafter, will be referred to as NTC thermistor), a first resistor R1, and a second resistor R2. The first and second resistors R1 and R2 are connected to each other in series between a reference voltage Vref and a ground voltage VSS, and the NTC thermistor Rt is connected to the first resistor R1 in parallel between a connection node Ne at which the first and second resistors R1 and R2 are connected to each other and the reference voltage Vref. The NTC thermistor Rt has a variable resistance value that varies depending on the ambient temperature, and as a result, an electric potential at the connection node Ne may be changed depending on the ambient temperature. The electric potential at the connection node Ne is applied to a temperature calculator 152 of the temperature sensor 150, and the temperature calculator 152 converts the electric potential of the connection node Ne to a digital signal. The converted digital signal may be applied to the signal controller 100 as the temperature signal TS having temperature information.

The protection operation setting unit 330 may set conditions of the protection operation in response to the selection signal SEL. In one exemplary embodiment for example, the protection operation setting unit 330 may change a level of the reference current Iref in response to the selection signal SEL.

Referring back to FIG. 2, in an exemplary embodiment, the control signal generator 310, the protection circuit unit 320, and the protection operation setting unit 330 may be installed or integrated in a power control chip 450. In such an embodiment, the temperature sensor 150 senses the ambient temperature at an outside of the power control chip 450. In a case where the temperature sensor 150 is installed in the power control chip 450, the ambient temperature of the power control chip 450 may not be accurately sensed. Accordingly, in an exemplary embodiment, the temperature sensor 150 may be located outside the power control chip 450 to accurately sense the ambient temperature thereof.

Figure 4:
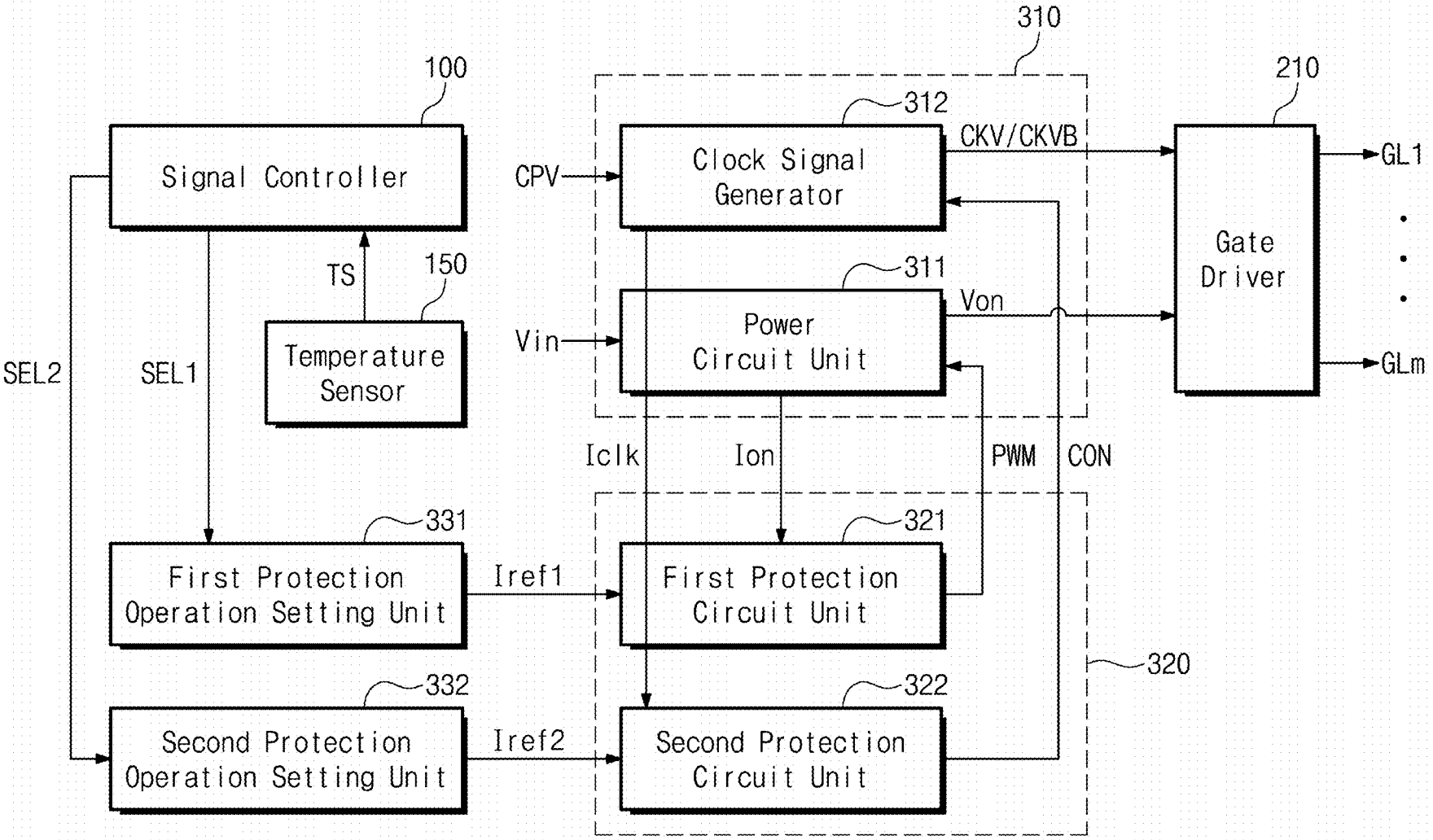
FIG. 4 is a block diagram showing a display panel driving device according to an alternative exemplary embodiment of the disclosure.
Figures 5, 6:
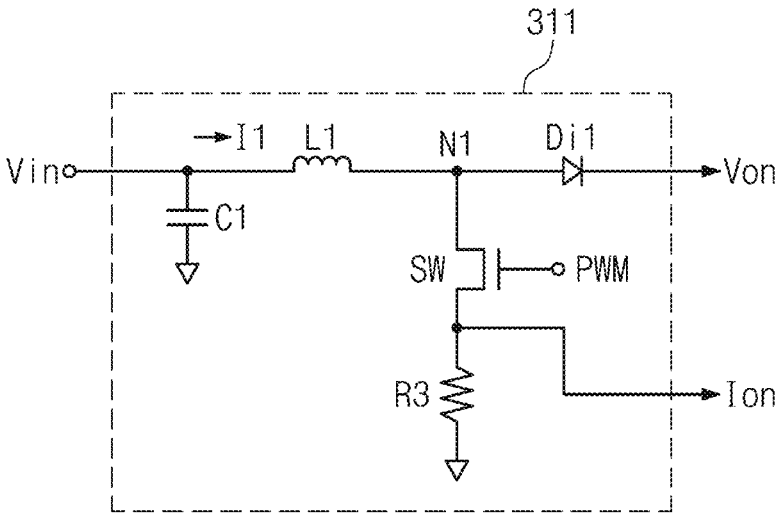
FIG. 5 is a circuit diagram showing an exemplary embodiment of a power supply circuit unit.
FIG. 6 is a view showing an exemplary embodiment of a setting of a first protection operation setting unit shown in FIG. 4.

FIG. 4 is a block diagram showing a display panel driving device according to an alternative exemplary embodiment of the disclosure, FIG. 5 is a circuit diagram showing an exemplary embodiment of a power supply circuit unit, and FIG. 6 is a view showing an exemplary embodiment of a setting of a first protection operation setting unit shown in FIG. 4.

Referring to FIG. 4, the control signal generator 310 may include a power circuit unit 311 and a clock signal generator 312. In an exemplary embodiment, as shown in FIG. 4, the control signal generator 310 includes the power circuit unit 311 and the clock signal generator 312, but not being limited thereto or thereby. According to an alternative exemplary embodiment, the control signal generator 310 may further include circuits to generate various signals and voltages used to drive the gate driver 210 and the data driver 220 and/or level shift circuits.

The power circuit unit 311 converts the input voltage Vin to the gate driving voltage Von, and outputs the gate driving voltage Von to the gate driver 210.

In an exemplary embodiment, as shown in FIG. 5, the power circuit unit 311 may boost the input voltage Vin, and output the gate driving voltage Von based on the boosted input voltage Vin through an output terminal thereof.

The power circuit unit 311 may include a coil L1, a transistor SW, a diode Di1, and a resistor R3. One end of the coil L1 is connected to an input terminal to which the input voltage Vin is input, and the other end of the coil L1 is connected to a first node N1. The diode Di1 includes an anode connected to the first node N1 and a cathode connected to the output terminal from which the gate driving voltage Von is output. The transistor SW includes a gate for receiving a switching signal PWM from the protection circuit unit 320, a drain connected to the first node N1, and a source connected to a ground terminal through the resistor R3. A capacitor C1 may be connected between the input terminal and the ground terminal.

In such an embodiment, an on/off of the transistor SW is controlled based on a signal level of the switching signal PWM output from the protection circuit unit 320. When the switching signal PWM has a low level, the transistor SW is turned off, and a current I1 flowing through the coil L1 gradually increases in proportion to the input voltage Vin applied to both ends of the coil L1 depending on current and voltage characteristics of the coil L1. When the switching signal PWM has a high level, the transistor SW is turned on, and the current I1 flowing through the coil L1 flows through the diode Di1. The voltage level of the gate driving voltage Von is determined depending on a level of the current I1 flowing through the coil L1.

In such an embodiment, since the level of the current I1 flowing through the coil L1 varies depending on a duty ratio of the switching signal PWM, the voltage level of the gate driving voltage Von is determined depending on the duty ratio of the switching signal PWM.

Referring back to FIG. 4, the clock signal generator 312 converts the gate clock signal CPV to the clock signal CKV and the clock bar signal CKVB, and outputs the clock signal CKV and the clock bar signal CKVB to the gate driver 210.

The protection circuit unit 320 includes a first protection circuit unit 321 and a second protection circuit unit 322.

The first protection circuit unit 321 receives a first feedback current Ion from the power circuit unit 311, and compares the first feedback current Ion with a first reference current Iref1 to control the duty ratio of the switching signal PWM based on the result of comparison or to block the output of the switching signal PWM.

The second protection circuit unit 322 receives a second feedback current Iclk from the clock signal generator 312, and compares the second feedback current Iclk with a second reference current Iref2. The second protection circuit unit 322 controls an operation of the clock signal generator 312 based on a result of comparison. When the clock signal CKV (or the clock bar signal CKVB) is applied to the gate driver 210 in a state where a defect due to a disconnected or shorted clock line occurs, the second feedback current Iclk may increase. In an exemplary embodiment, when the second feedback current Iclk is not in a normal range or exceeds the normal range, the second protection circuit unit 322 generates an operation control signal CON controlling an operation of the clock signal generator 312 to stop, and applies the operation control signal CON controlling an operation of the clock signal generator 312 to stop to the clock signal generator 312. In such an embodiment, when the second feedback current Iclk is in the normal range, the second protection circuit unit 322 may output the operation control signal CON controlling the operation of the clock signal generator 312 to maintain to the clock signal generator 312.

The operation of the second protection circuit unit 322 will be described in greater detail with reference to FIGS. 8 to 11B.

In an exemplary embodiment, as shown in FIG. 4, the protection operation setting unit 330 may include a first protection operation setting unit 331 and a second protection operation setting unit 332.

The first protection operation setting unit 331 receives a first selection signal SEL1, which is generated based on the ambient temperature information, from the signal controller 100, selects reference information appropriate to the ambient temperature, and provides the reference information to the first protection circuit unit 321. In one exemplary embodiment, for example, the first protection operation setting unit 331 may change a level of the first reference current Iref1, which is compared with the first feedback current Ion, in response to the first selection signal SEL1, and apply the first reference current Iref1 having the changed level to the first protection circuit unit 321.

In an exemplary embodiment, as shown in FIG. 6, the first protection operation setting unit 331 may include a storage table in which values having different current levels depending on the temperature are stored as the first reference current Iref1. In an exemplary embodiment, "n" temperature values T1 to Tn and "n" reference current values Ion ref1 to Ion refn are stored in the storage table. The first protection operation setting unit 331 selects the current level value corresponding to a temperature value corresponding to the first selection signal SEL1 among the "n" temperature values T1 to Tn, and outputs a current having the selected current level value as the first reference current Iref1.

Referring back to FIG. 4, the second protection operation setting unit 332 receives a second selection signal SEL2, which is generated based on the ambient temperature information, from the signal controller 100, selects reference information appropriate to the ambient temperature, and provides the reference information to the second protection circuit unit 322. In one exemplary embodiment, for example, the second protection operation setting unit 332 may change a level of the second reference current Iref2, which is compared with the second feedback current Iclk, in response to the second selection signal SEL2, and apply a current having the changed level as the second reference current Iref2 to the second protection circuit unit 322.

The second protection operation setting unit 332 will be described in greater detail with reference to FIGS. 8 to 11B.

Figure 7:
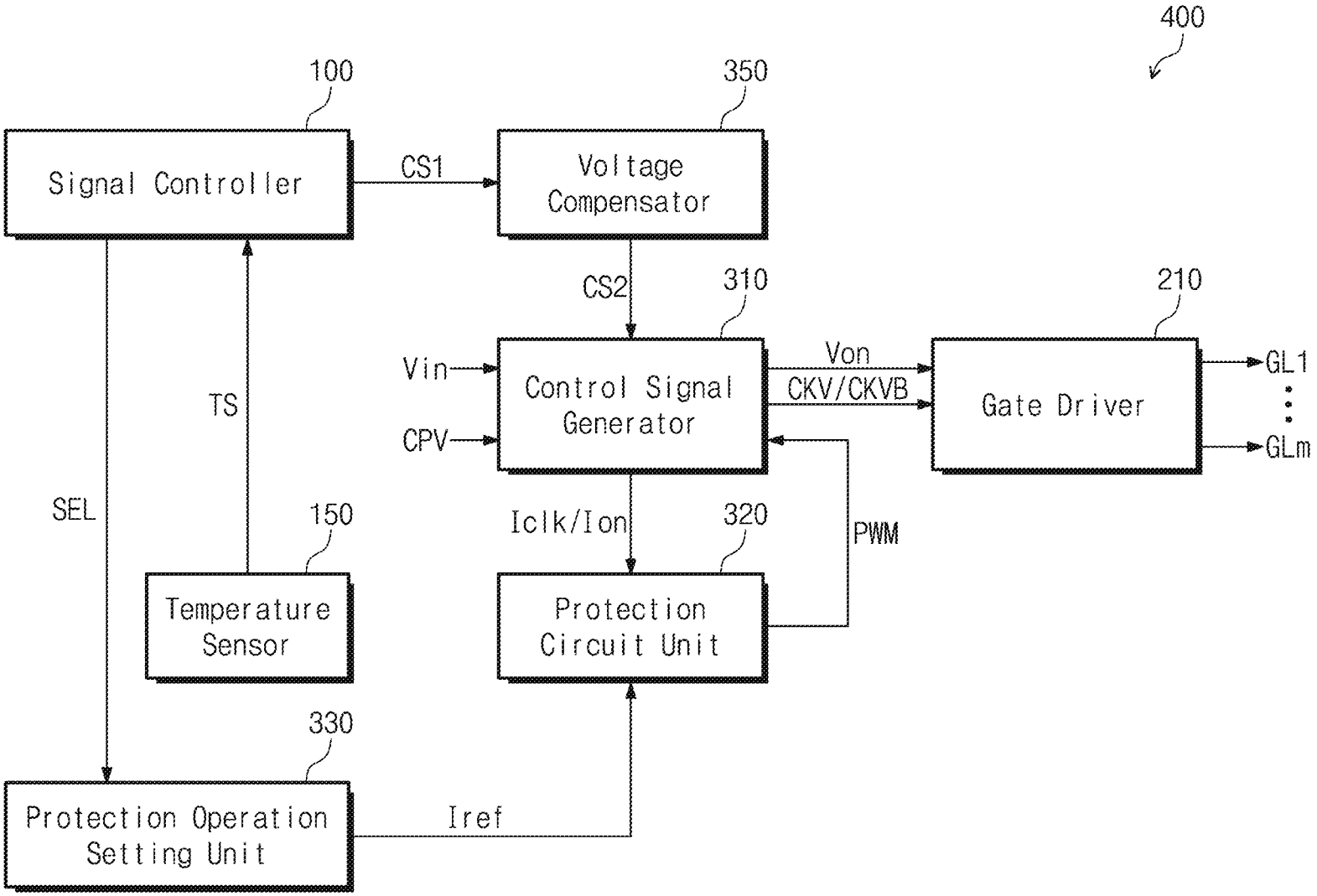
FIG. 7 is a block diagram showing a display panel driving device according to another exemplary embodiment of the disclosure.

FIG. 7 is a block diagram showing a display panel driving device 400 according to another alternative exemplary embodiment of the disclosure.

Referring to FIG. 7, in an exemplary embodiment, the display panel driving device 400 further includes a voltage compensator 350.

The voltage compensator 350 may receive a first compensation signal CS1, which is generated based on the ambient temperature, from the signal controller 100. The voltage compensator 350 may control the control signal generator 310 to change the voltage level of the gate driving voltage Von based on the ambient temperature. In one exemplary embodiment, for example, where the gate driving voltage Von is about 30 volts in a room temperature environment, the voltage compensator 350 may apply a second compensation signal CS2 to the control signal generator 310 to allow the gate driving voltage Von to become about 38 volts in a low temperature environment. Accordingly, the control signal generator 310 may boost the gate driving voltage Von to about 38 volts in response to the second compensation signal CS2 and output the boosted gate driving voltage Von.

In such an embodiment, as described above, where the gate driving voltage Von is compensated, the signal controller 100 may apply the selection signal to the protection operation setting unit 330 such that a protection operation appropriate to the compensated gate driving voltage Von is performed. The protection operation setting unit 330 selects the reference current Iref appropriate to the compensated gate driving voltage Von in response to the selection signal SEL, and applies the selected reference current Iref to the protection circuit unit 320.

When the protection circuit unit 320 compares the reference current Iref, which is not compensated, with the feedback current Ion even though the gate driving voltage Von is compensated, the protection operation may not be normally performed. Accordingly, in an exemplary embodiment, the protection operation setting unit 330 may appropriately change the level of the reference current Iref depending on the compensation of the gate driving voltage Von and transmit the reference current Iref to the protection circuit unit 320. Thus, the protection circuit unit 320 may detect an abnormality in the feedback current Ion on an appropriate condition.

FIG. 8 is a view showing a table stored in the second protection operation setting unit 332 shown in FIG. 4.

Referring to FIGS. 4 and 8, the second protection operation setting unit 332 may include a first storage table 332*a* in which a second reference current level value depending on the temperature is stored, a second storage table 332*b* in which a reference time point depending on the temperature is stored, and a third storage table 332*c* in which the number of reference counts depending on the temperature is stored.

As shown in FIG. 8, "i" temperature values T1 to Ti and "i" reference current levels Iclk_ref1 to Iclk_refi are stored in the first storage table 332*a*. The second protection operation setting unit 332 may select the current level value corresponding to one temperature value corresponding to the second selection signal SEL2 among the "i" temperature values T1 to Ti, and output a current having the selected current level as the second reference current Iref2.

As shown in FIG. 8, "j" temperature values T1 to Tj and "j" reference time point values Time_ref1 to Time_refj are stored in the second storage table 332*b*. The second protection operation setting unit 332 may select the reference time point value corresponding to one temperature value corresponding to the second selection signal SEL2 among the "j" temperature values T1 to Tj, and output a time point having the selected reference time point value as a reference time point Tref.

As shown in FIG. 8, "k" temperature values T1 to Tk and "k" reference count number values Count_ref1 to Count_refk are stored in the third storage table 332*c*. The second protection operation setting unit 332 may select the reference count number value corresponding to one temperature value corresponding to the second selection signal SEL2 among the "k" temperature values T1 to Tk, and output the selected reference count number value as the reference count number.

Herein, each of "i", "j", and "k" is an integer equal to or greater than 1, and "i", "j", and "k" may be the same as each other or different from each other.

FIG. 4 shows an exemplary embodiment having the structure in which the second protection operation setting unit 332 applies the second reference current Iref2 to the second protection circuit unit 322. However, in such an embodiment, as shown in FIG. 8, the second protection operation setting unit 332 may further transmit the reference time point Tref and the reference count number to the second protection circuit unit 322 in addition to the second reference current Iref2.

Figure 9:
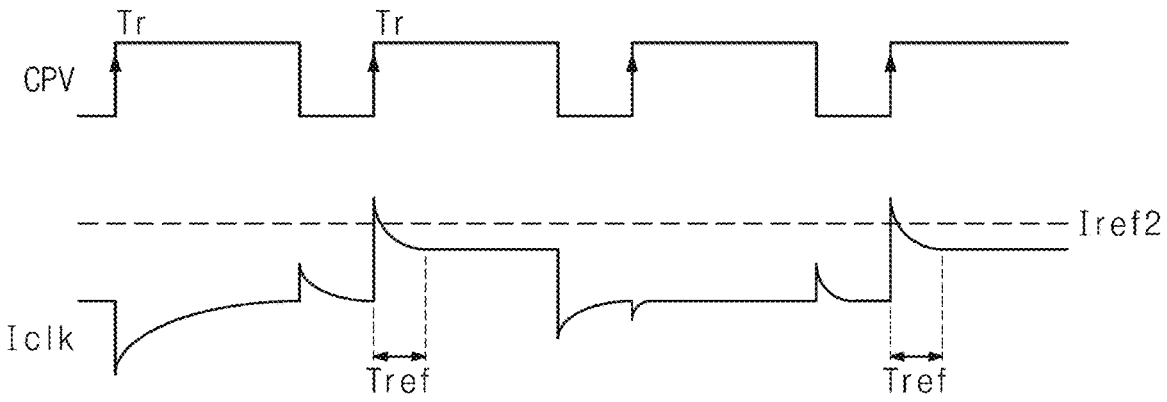
FIG. 9 is a waveform diagram showing an operation of a second protection circuit unit shown in FIG. 4.
Figure 10:
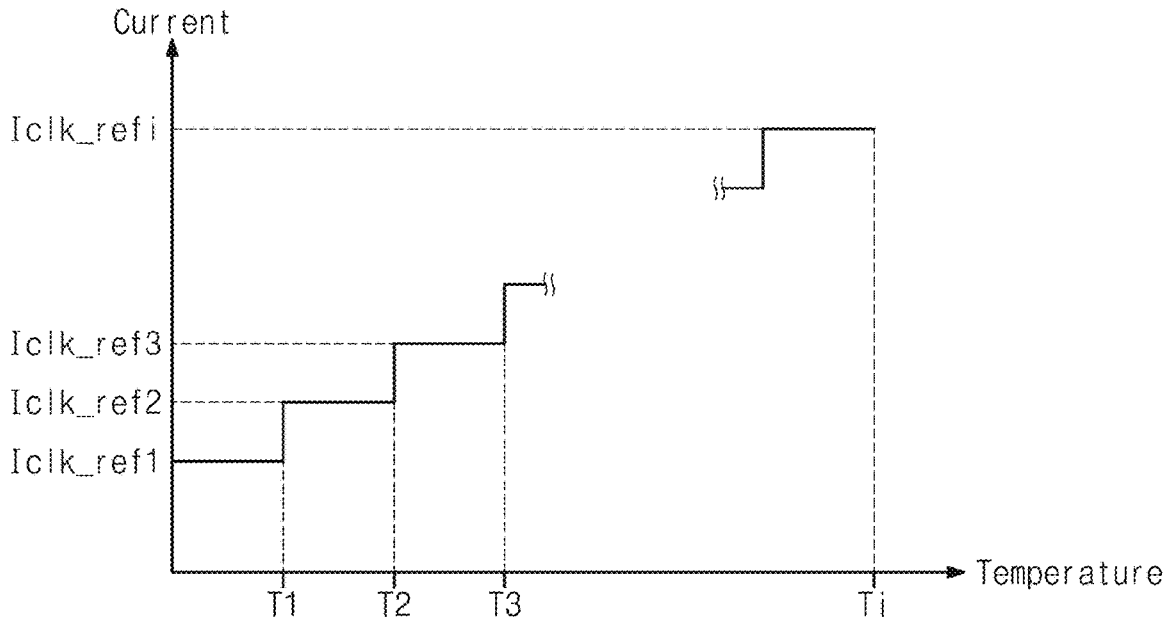
FIG. 10 is a graph showing a variation of a second reference current as a function of a temperature.

FIG. 9 is a waveform diagram showing an operation of the second protection circuit unit 322 shown in FIG. 4, and FIG. 10 is a graph showing a variation of the second reference current Iref2 as a function of a temperature.

Referring to FIG. 9, the second protection circuit unit 322 may compare the second feedback current Iclk feedback at the reference time point Tref with the second reference current Iref2. Here, the reference time point Tref may be a time point that is delayed from a rising time point Tr of the gate clock signal CPV by a reference time.

As shown in FIG. 8, the reference time point Tref may have a variable value depending on the temperature. In an exemplary embodiment, as the temperature increases, the reference time point Tref may move in a direction away from the rising time point.

Referring to FIG. 10, a level of the second reference current Iref2 may increase as the temperature increases. Here, the temperature may be set by ranges. In an exemplary embodiment, the second reference current Iref2 may be set to the first reference current level Iclk_ref1 in a first temperature range below a first temperature T1 and set to the second reference current level Iclk ref2 in a second temperature range between the first temperature T1 and a second temperature T2.

In an exemplary embodiment where the current level of the second reference current Iref2 varies depending on the temperature range, the reference time point Tref may not vary depending on the temperature. In such an embodiment, the abnormality in the second feedback current Iclk may be detected by fixing the reference time point Tref to one of the "j" reference time point values Time_ref1 to Time_refj (refer to FIG. 8) independently of the temperature and varying only the current level depending on the temperature.

In an alternative exemplary embodiment where the time value of the reference time point Tref varies depending on the temperature section, the current level value of the second reference current Iref2 may be constant without varying. In such an embodiment, the abnormality in the second feedback current Iclk may be detected by fixing the second reference current Iref2 to one of the "i" reference current levels Iclk_ref1 to Iclk_refi (refer to FIG. 8) independently of the temperature and varying only the reference time point value depending on the temperature.

Figure 11A:
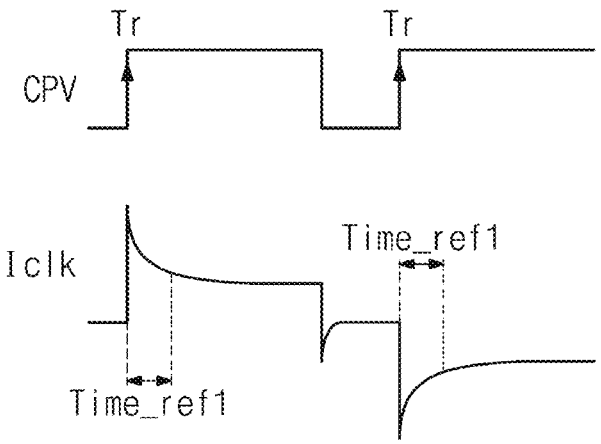
FIGS. 11A and 11B are waveform diagrams showing a variation of a reference time point as a function of a temperature.
Figure 11B:
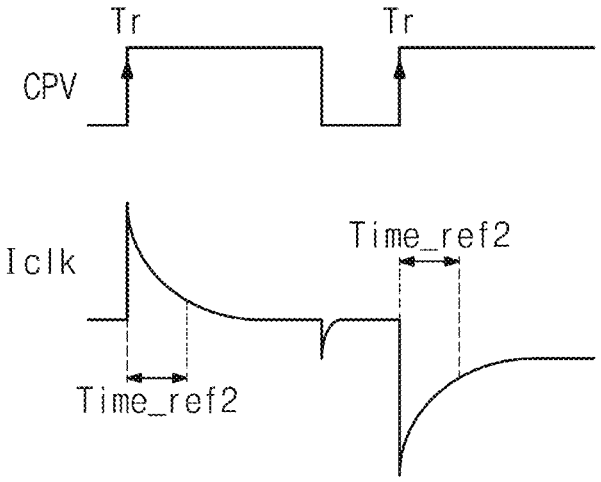

FIGS. 11A and 11B are waveform diagrams showing a variation of a reference time point as a function of a temperature.

In FIGS. 11A and 11B, the second reference current Iref2 is fixed to a specific current level, and the reference time point Tref is changed to the second reference time point Time ref2 from the first reference time point Time_ref1. In FIGS. 11A and 11B, the second reference time point Time_ref1 is located farther away from the corresponding rising time point Tr than the first reference time point Time_ref1.

Referring to FIGS. 4, 8 and 11A, in an exemplary embodiment, the second protection circuit unit 322 compares the second feedback current Iclk with the second reference current Iref2 at the first reference time point Time_ref1 and detects the abnormality of the clock signal CKV and the short circuit of the clock line based on a result of comparison.

In such an embodiment, when the reference time point Tref is changed to the second reference time point Time ref2 due to the variation in the ambient temperature, as shown in FIG. 11B, the second protection circuit unit 322 compares the second feedback current Iclk with the second reference current Iref2 at the second reference time point Time ref2 and detects the abnormality of the clock signal CKV based on a result of comparison.

Figure 12A:
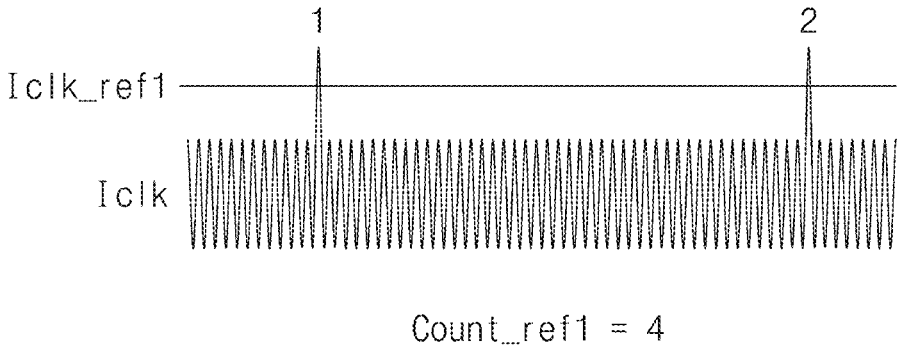
FIGS. 12A and 12B are waveform diagrams showing a variation of a reference count number as a function of a temperature.
Figure 12B:
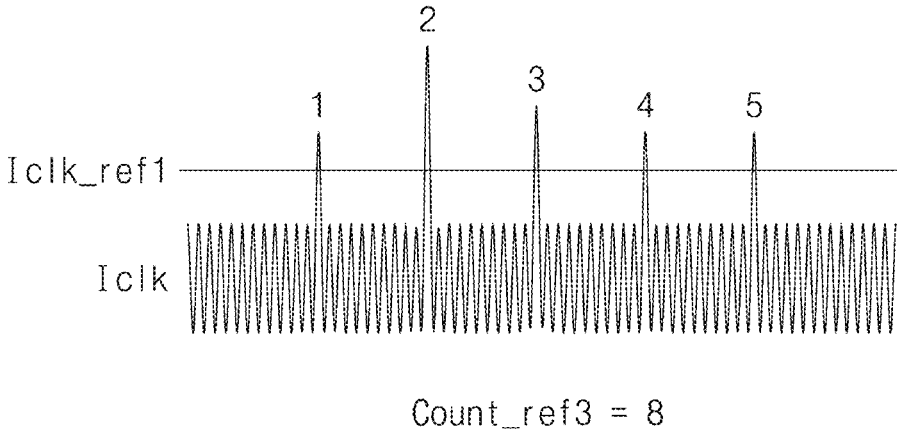

FIGS. 12A and 12B are waveform diagrams showing a variation of the reference count number as a function of the temperature.

Referring to FIGS. 4, 8, 12A, and 12B, in an exemplary embodiment, the second protection circuit unit 322 compares the second feedback current Iclk, which is feedback at the reference time point Tref, with the second reference current Iref2, and outputs a result signal in a first state when the second feedback current Iclk is greater than the second reference current Iref2.

In such an embodiment, the second protection circuit unit 322 may count the number of times in which the result signal has the first state during a predetermined time period. The second protection circuit unit 322 compares the counted number with the reference count number and determines whether to perform the protection operation.

The reference count number may be set as a first reference count number Count_ref1 at the room temperature, and the reference count number Cref may be set as a third reference count number Count ref3 at the high temperature. As shown in FIG. 12A, when the number of times in which the second feedback current Iclk exceeds the second reference current Iref2 is 2 (two times) and the first reference count number Count_ref1 is 4 (four times), the clock signal CKV may not be determined as abnormal. That is, the clock signal CKV may be determined as abnormal only when the number of times in which the second feedback current Iclk exceeds the second reference current Iref2 4 (four times) or more at the room temperature during the given time period.

When the reference count number is set as the third reference count number Count ref3 and the number of times in which the second feedback current Iclk exceeds the second reference current Iref2 is 5 (five times) at the high temperature, the clock signal CKV may not be determined as abnormal. That is, the clock signal CKV may be determined as abnormal only when the number of times in which the second feedback current Iclk exceeds the second reference current Iref2 8 (eight times) or more at the high temperature during the given time period.

Figure 13:
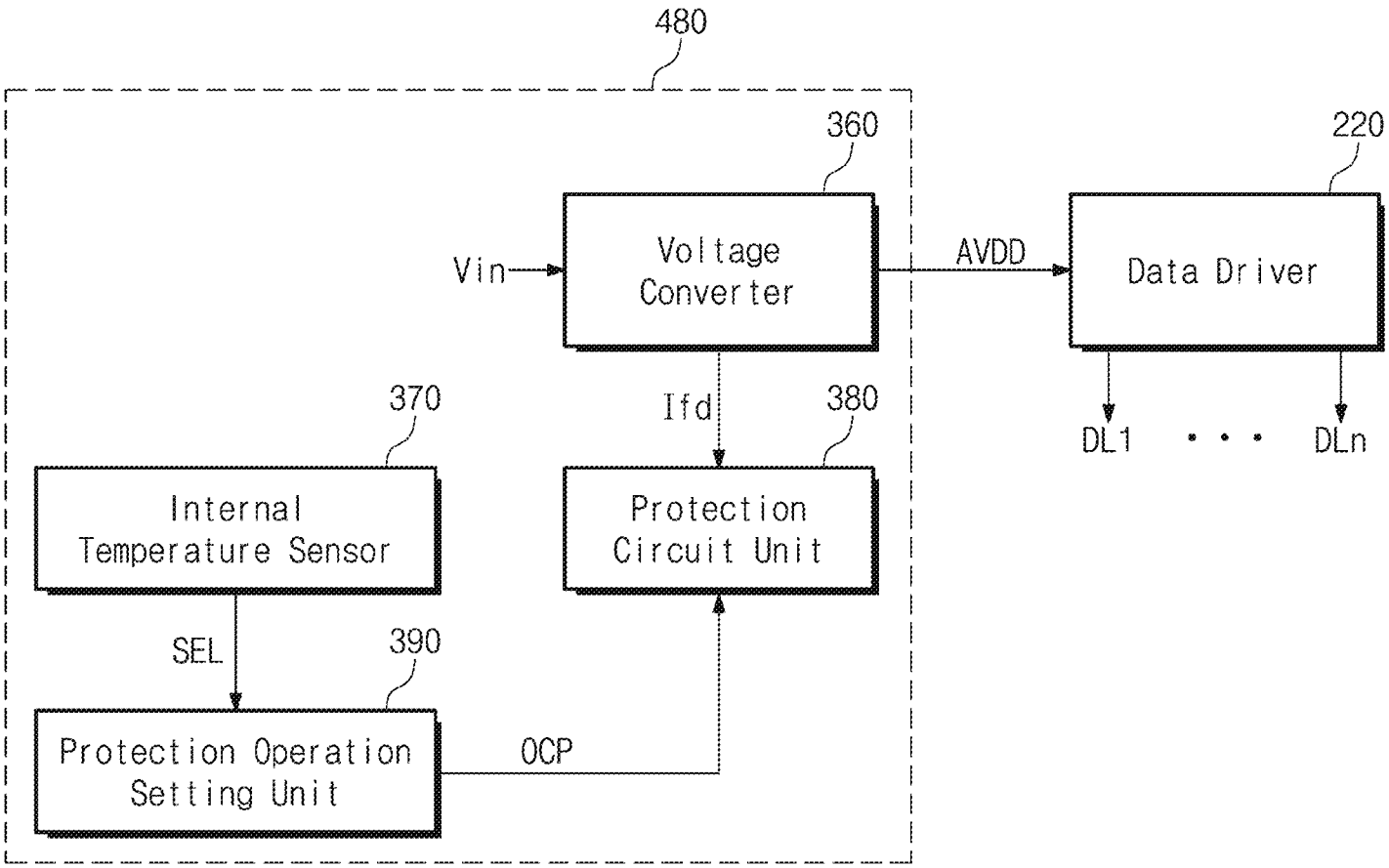
FIG. 13 is a block diagram showing a display panel driving device according to another alternative exemplary embodiment of the disclosure.

FIG. 13 is a block diagram showing a display panel driving device according to another alternative exemplary embodiment of the disclosure.

Referring to FIG. 13, the display panel driving device according to another embodiment of the disclosure includes a power control chip 480 that outputs a driving voltage AVDD and a driving unit that receives the driving voltage AVDD and outputs a panel driving signal. For the convenience of illustration and description, FIG. 13 shows only a data driver 220 of the driving unit.

In an exemplary embodiment, the power control chip 480 includes a voltage converter 360, an internal temperature sensor 370, a protection circuit unit 380, and a protection operation setting unit 390.

The voltage converter 360 converts an input voltage Vin to the driving voltage AVDD and outputs the driving voltage AVDD. In an exemplary embodiment, the driving voltage AVDD may be an analog driving voltage provided to the data driver 220.

The protection circuit unit 380 receives a feedback current Ifd from the voltage converter 360, compares the feedback current Ifd with a predetermined reference current OCP, and performs the protection operation based on a result of comparison.

The internal temperature sensor 370 senses a temperature in the power control chip 480. The protection operation setting unit 390 controls a level of the reference current OCP depending on the sensed temperature in the power control chip 480.

The controlling of the level of the reference current OCP depending on the sensed temperature is similar to the above-mentioned descriptions, and thus any repetitive detailed description thereof will be omitted.

In such an embodiment, the internal temperature sensor 370 sensing the internal temperature of the power control chip 480 is installed in the power control chip 480.

Accordingly, in such an embodiment, the protection operation setting unit 390 may change the reference level depending on the internal temperature of the power control chip 480, and thus the protection circuit unit 380 may determine whether the abnormality occurs in the feedback current Ifd based on the changed reference level of the reference current OCP.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display panel driving device which drives a display panel, comprising:

a control signal generator which outputs a driving control signal;

a driving unit which receives the driving control signal to output a display panel driving signal;

a protection circuit unit which receives a feedback current from the control signal generator and compares the feedback current with a reference current to perform a protection operation based on a result of comparison of the feedback current with the reference current;

a temperature sensor which senses an ambient temperature;

a controller which outputs a selection signal variable depending on the sensed ambient temperature; and a protection operation setting unit which sets a condition of the protection operation in response to the selection signal, wherein the protection operation includes at least one of stopping the output and controlling a voltage level of the display panel driving signal to the display panel.

2. The display panel driving device of claim 1, wherein the control signal generator comprises:

a power circuit unit which converts an input voltage to a gate driving voltage to output the gate driving voltage to the driving unit; and a clock signal generator which generates a clock signal and a clock bar signal based on a gate clock signal to output the clock signal and the clock bar signal to the driving unit.

3. The display panel driving device of claim 2, wherein the feedback current comprises a first feedback current and a second feedback current, and the protection circuit unit comprises:

a first protection circuit unit connected to the power circuit unit to receive the first feedback current therefrom; and a second protection circuit unit connected to the clock signal generator to receive the second feedback current therefrom.

4. The display panel driving device of claim 3, wherein the protection operation setting unit comprises:

a first protection operation setting unit which sets a protection operation condition of the first protection circuit unit; and a second protection operation setting unit which sets a protection operation condition of the second protection circuit unit.

5. The display panel driving device of claim 4, wherein the first protection operation setting unit comprises a storage table which stores a level of a first reference current corresponding to a temperature.

6. The display panel driving device of claim 5, further comprising:

a voltage compensator which controls a voltage level of the gate driving voltage based on the sensed ambient temperature, wherein the controller selects a level of the reference current based on the sensed ambient temperature and whether the gate driving voltage is compensated.

7. The display panel driving device of claim 4, wherein the second protection operation setting unit comprises:

a first storage table which stores a level of a second reference current corresponding to a temperature;

a second storage table which stores a time difference from a rising time point of the gate clock signal to a reference time point corresponding to a temperature; and a third storage table which stores a reference count number corresponding to a temperature.

8. The display panel driving device of claim 7, wherein the second protection circuit unit holds the level of the second reference current and varies the reference time point depending on the sensed ambient temperature to sense an abnormality in the second feedback current.

9. The display panel driving device of claim 7, wherein the second protection circuit unit holds the reference time point and varies the level of the second reference current depending on the sensed ambient temperature to sense an abnormality in the second feedback current.

10. The display panel driving device of claim 7, wherein the reference count number in the third storage table has a value which increases as the sensed ambient temperature increases.

11. The display panel driving device of claim 2, wherein the driving unit comprises:

a gate driver which applies a gate signal to the display panel; and a data driver which applies a data signal to the display panel, wherein the gate driver receives the gate driving voltage, the clock signal and the clock bar signal.

12. The display panel driving device of claim 11, wherein the protection circuit unit, the control signal generator and the protection operation setting unit are in a single power control chip, and the temperature sensor senses the ambient temperature at outside of the power control chip.

13. The display panel driving device of claim 12, further comprising:

a signal controller which controls the gate driver and the data driver, wherein the controller is in the signal controller and transmits the selection signal to the power control chip.

14. A display panel driving device which drives a display panel, comprising:

a power control chip which outputs a driving voltage; and a driving unit which receives the driving voltage to output a display panel driving signal, wherein the power control chip comprises:

a voltage converter which converts an input voltage to the driving voltage;

a protection circuit unit which receives a feedback current from the voltage converter and compares the feedback current with a reference current to perform a protection operation based on a result of comparison of the feedback current with the reference current;

a temperature sensor which senses a temperature inside the power control chip; and a protection operation setting unit which controls a level of the reference current based on the sensed temperature, wherein the protection operation includes at least one of stopping the output and controlling a voltage level of the display panel driving signal to the display panel.

15. The display panel driving device of claim 14, wherein the driving unit comprises:

a gate driver which applies a gate signal to the display panel; and a data driver which applies a data signal to the display panel, wherein the data driver receives the driving voltage.

16. The display panel driving device of claim 14, wherein the protection operation setting unit increases the level of the reference current as the temperature increases.

17. A display apparatus comprising:

a display panel which displays an image; and a driving device which drives the display panel, wherein the driving device comprises:

a control signal generator which outputs a driving control signal;

a driving unit which receives the driving control signal to output a display panel driving signal;

a protection circuit unit which receives a feedback current from the control signal generator and compares the feedback current with a reference current to perform a protection operation based on a result of comparison of the feedback current with the reference current;

a temperature sensor which senses an ambient temperature;

a controller which outputs a selection signal variable depending on the sensed ambient temperature; and a protection operation setting unit which sets a condition of the protection operation in response to the selection signal, wherein the protection operation includes at least one of stopping the output and controlling a voltage level of the display panel driving signal to the display panel.

18. The display apparatus of claim 17, wherein the protection circuit unit and the protection operation setting unit are in a single power control chip, and the temperature sensor senses the ambient temperature at outside of the power control chip.

19. The display apparatus of claim 18, wherein the driving unit comprises:

a gate driver which applies a gate signal to the display panel; and a data driver which applies a data signal to the display panel, wherein the data driver receives an analog driving voltage.

20. The display apparatus of claim 19, further comprising:

a signal controller which controls an operation of the gate driver and the data driver, wherein the controller is in the signal controller and transmits the selection signal to the power control chip.

21. The display apparatus of claim 19, wherein the power control chip further comprises an internal temperature sensor which senses a temperature inside the power control chip.

* * * * *